US009280984B2

(12) United States Patent
Chen et al.

(10) Patent No.: US 9,280,984 B2
(45) Date of Patent: Mar. 8, 2016

(54) NOISE CANCELLATION METHOD

(75) Inventors: Lei Chen, Taoyuan County (TW); Yu-Chieh Lai, Taoyuan County (TW); Chun-Ren Hu, Taoyuan County (TW); Hann-Shi Tong, Taoyuan County (TW)

(73) Assignee: HTC CORPORATION, Taoyuan (TW)

( * ) Notice: Subject to any disclaimer, the term of this patent is extended or adjusted under 35 U.S.C. 154(b) by 907 days.

(21) Appl. No.: 13/471,085

(22) Filed: May 14, 2012

(65) Prior Publication Data

US 2013/0304463 A1 Nov. 14, 2013

(51) Int. Cl.

| | |
|---|---|
| ***G10L 21/02*** | (2013.01) |
| ***G10L 21/0232*** | (2013.01) |
| ***H04R 3/00*** | (2006.01) |
| *G10L 21/0208* | (2013.01) |

(52) U.S. Cl.
CPC ..... *G10L 21/0232* (2013.01); *H04R 3/00* (2013.01); *G10L 2021/02082* (2013.01); *H04R 2410/07* (2013.01)

(58) Field of Classification Search
CPC ..... G10L 21/0208; G10L 21/0232
USPC ..... 704/226, 233; 381/94.3
See application file for complete search history.

(56) References Cited

U.S. PATENT DOCUMENTS

| | | | | | |
|---|---|---|---|---|---|
| 4,630,304 | A * | 12/1986 | Borth et al. | 381/94.3 |
| 5,012,519 | A * | 4/1991 | Adlersberg et al. | 704/226 |
| 5,400,409 | A * | 3/1995 | Linhard | 381/92 |
| 5,742,927 | A * | 4/1998 | Crozier et al. | 704/226 |
| 5,839,101 | A * | 11/1998 | Vahatalo et al. | 704/226 |
| 5,933,495 | A * | 8/1999 | Oh | 379/406.08 |
| 6,038,532 | A * | 3/2000 | Kane et al. | 704/233 |
| 6,044,341 | A * | 3/2000 | Takahashi | 704/226 |
| 6,122,384 | A * | 9/2000 | Mauro | 381/94.3 |
| 6,295,364 | B1 * | 9/2001 | Finn et al. | 381/110 |
| 6,480,823 | B1 * | 11/2002 | Zhao et al. | 704/226 |
| 6,510,224 | B1 * | 1/2003 | Christensson et al. | 379/406.03 |
| 6,766,292 | B1 * | 7/2004 | Chandran et al. | 704/224 |
| 7,885,420 | B2 * | 2/2011 | Hetherington et al. | 381/94.2 |
| 8,515,097 | B2 * | 8/2013 | Nemer et al. | 381/94.1 |
| 2001/0016020 | A1 * | 8/2001 | Gustafsson et al. | 375/346 |
| 2003/0040908 | A1 * | 2/2003 | Yang et al. | 704/233 |
| 2004/0111258 | A1 * | 6/2004 | Zangi et al. | 704/226 |
| 2004/0167777 | A1 * | 8/2004 | Hetherington et al. | 704/226 |
| 2005/0213778 | A1 * | 9/2005 | Buck et al. | 381/94.3 |
| 2007/0280472 | A1 * | 12/2007 | Stokes, III et al. | 379/406.01 |
| 2008/0069373 | A1 * | 3/2008 | Jiang et al. | 381/94.1 |
| 2008/0077399 | A1 * | 3/2008 | Yoshida | 704/208 |

(Continued)

FOREIGN PATENT DOCUMENTS

| | | | |
|---|---|---|---|
| CN | 1530929 | A | 9/2004 |
| CN | 1684143 | A | 10/2005 |

(Continued)

*Primary Examiner* — Jialong He

(74) *Attorney, Agent, or Firm* — Birch, Stewart, Kolasch & Birch, LLP

(57) ABSTRACT

An embodiment of the invention provides a noise cancellation method for an electronic device. The method comprises: receiving an audio signal; applying a Fast Fourier Transform operation on the audio signal to generate a sound spectrum; acquiring a first spectrum corresponding to a noise and a second spectrum corresponding to a human voice signal from the sound spectrum; estimating a center frequency according to the first spectrum and the second spectrum; and applying a high pass filtering operation to the sound spectrum according to the center frequency.

5 Claims, 11 Drawing Sheets

(56) References Cited

U.S. PATENT DOCUMENTS

| | | | | |
|---|---|---|---|---|
| 2009/0119099 | A1* | 5/2009 | Lee et al. | 704/226 |
| 2009/0248411 | A1* | 10/2009 | Konchitsky et al. | 704/242 |
| 2009/0281805 | A1* | 11/2009 | LeBlanc et al. | 704/233 |
| 2010/0020986 | A1 | 1/2010 | Nemer et al. | |
| 2010/0082339 | A1* | 4/2010 | Konchitsky et al. | 704/226 |
| 2010/0232619 | A1 | 9/2010 | Uhle et al. | |
| 2010/0254541 | A1 | 10/2010 | Hayakawa | |
| 2011/0004470 | A1* | 1/2011 | Konchitsky et al. | 704/226 |
| 2013/0196715 | A1* | 8/2013 | Hansson et al. | 455/563 |

FOREIGN PATENT DOCUMENTS

| | | | |
|---|---|---|---|
| CN | 101154382 | A | 4/2008 |
| CN | 101430882 | A | 5/2009 |
| CN | 101582264 | A | 11/2009 |
| EP | 1 339 256 | A2 | 8/2003 |
| JP | 6-269084 | A | 9/1994 |
| JP | 2012-63394 | A | 3/2012 |
| WO | WO 02/103680 | A3 | 12/2002 |
| WO | WO 2010/066008 | A1 | 6/2010 |
| WO | WO 2011/140110 | A1 | 10/2011 |

* cited by examiner

NOISE CANCELLATION METHOD

BACKGROUND OF THE INVENTION

1. Field of the Invention

The present invention relates to a noise cancellation method, and more particularly to a noise cancellation method for a portable device.

2. Description of the Related Art

Portable devices, such as a smart phone, tablet or personal digital assist (PDA), have become necessaries for consumers, personally or for business. More and more users use a portable device to shot a video or record a voice mail. The general portable device does not support noise cancellation for voice received by the microphone of the portable device, and wind noise may decrease the quality of the recorded voice no matter where the user is at, indoors or outdoors. When a user is outdoors, the microphone is easily affected by the wind noise. When the user is indoors, the microphone is easily affected by reflected voice signal. The noise suppression methods for the wind noise and the reflected voice signal are different and are not easily integrated in the portable device.

BRIEF SUMMARY OF THE INVENTION

An embodiment of the invention provides a noise cancellation method for an electronic device. The method comprises: receiving an audio signal; applying a Fast Fourier Transform operation on the audio signal to generate a sound spectrum; acquiring a first spectrum corresponding to a noise and a second spectrum corresponding to a human voice signal from the sound spectrum; estimating a center frequency according to the first spectrum and the second spectrum; and applying a high pass filtering operation to the sound spectrum according to the center frequency.

Another embodiment of the invention provides a noise cancellation method for an electronic device. The method comprises the steps of: receiving an audio signal; applying a Fast Fourier Transform operation on the audio signal to generate a sound spectrum; determining whether the electronic device is outdoors according to the sound spectrum; and executing the following steps when the electronic device is outdoors: acquiring a first spectrum corresponding to a noise and a second spectrum corresponding to a human voice signal from the sound spectrum; estimating a center frequency according to the first spectrum and the second spectrum; and applying a high pass filtering operation to the sound spectrum according to the center frequency.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
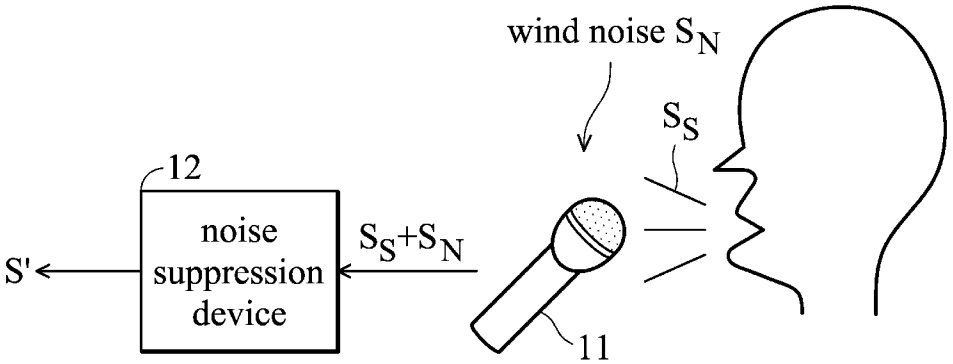
FIG. 1 is a schematic diagram of a noise cancellation method for a microphone according to an embodiment of the invention.

FIG. 1 is a schematic diagram of a noise cancellation method for a microphone according to an embodiment of the invention. The embodiment of FIG. 1 is illustrated with an outdoor situation. When the microphone 11 receives an audio signal SS of a user, the microphone may also receive a wind noise signal SN, wherein the signal received by the microphone can be expressed as (SS+SN). Then, a noise suppression device 12 executes a noise suppression operation on the signal (SS+SN) to cancel or suppress noise and then, an audio signal SS' is generated. In this embodiment, the audio signal SS' may still contain noise and is different from the audio signal SS. In this embodiment, the noise suppression device can be implemented by hardware or by a processor or controller executing a program.

Figure 2:
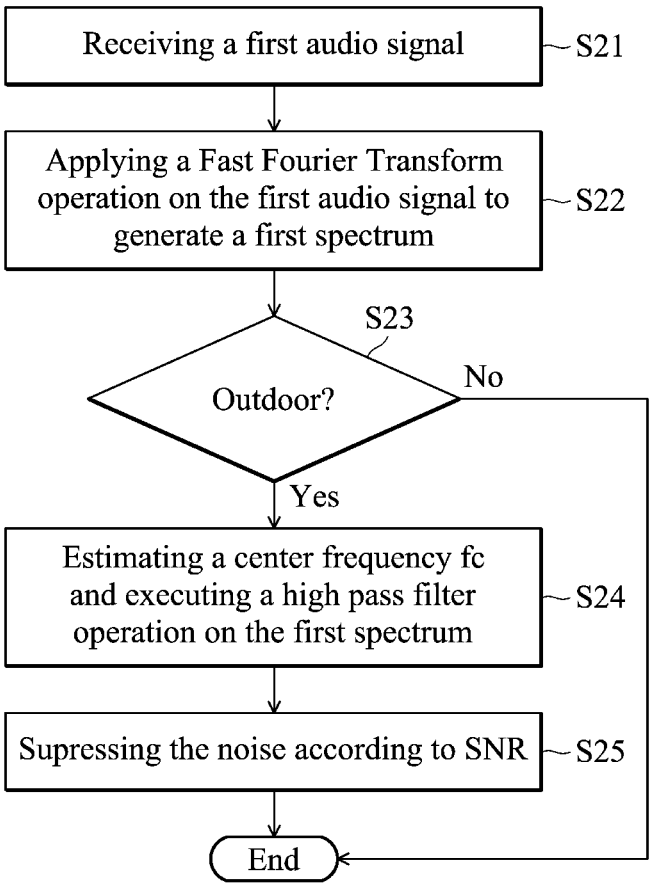
FIG. 2 is a flowchart of the operation method of the noise suppression device in FIG. 1 according to an embodiment of the invention.

FIG. 2 is a flowchart of the operation method of the noise suppression device in FIG. 1 according to an embodiment of the invention. In step S21, a microphone receives a first audio signal containing a speech signal of a user and wind noise. In step S22, a Fast Fourier Transform device applies a Fast Fourier Transform (FFT) operation on the first audio signal to generate a first spectrum. Generally speaking, the frequency of wind noise ranges from 0 to 100 Hz, and the frequency of human speech signals range from 300 Hz to 4K Hz. In this embodiment, a first frequency range corresponding to the wind noise and a second frequency range corresponding to the speech signal are set to acquire a noise spectrum corresponding to the first frequency range and a human speech spectrum corresponding to the second frequency range. In the step S23, the noise suppression device may determine whether a user is outdoors. The step can be implemented by user settings or the noise suppression device may determine that according to the spectrums acquired in step S22. For example, when the user uses a portable device to execute a video recording program or a voice recording program, an operational menu is jumped and shown on the display of the portable device for the user to input the user's location, being indoors or outdoors, and whether the noise cancellation or suppression operation should be executed. If the user is outdoors, the noise cancellation or suppression operation will be executed. If the user is not outdoors, the noise cancellation or suppression operation will not be executed. In another embodiment, the noise suppression device may determine whether a user is outdoors according to energy of the noise spectrum. If the energy is larger than a predetermined value, the user is determined to be outdoors and the noise cancellation or suppression operation will be executed. If the energy is less than the predetermined value, the noise cancellation or suppression operation will not be executed.

In the step S24, the noise suppression device estimates a center frequency fc according to a first energy of the noise spectrum and a second energy of a human speech spectrum. Then, a center frequency of a frequency domain high pass filter is adjusted according to the estimated center frequency. The first spectrum is then filtered by the frequency domain high pass filter to filter out the wind noise at a low frequency and a second spectrum is therefore generated. Then, in the step S25, the noise suppression device processes the second spectrum to enhance the human speech spectrum and suppress the noise spectrum according to the human speech spectrum and the noise spectrum, and a third spectrum is generated accordingly. An Inverse Fast Fourier Transform (IFFT) operation is then applied to the third spectrum to generate a filtered audio signal. The filtered audio signal is then stored or played by a speaker.

In FIG. 2, the estimated center frequency fc that is generated according to the first energy of the noise spectrum and the second energy of a human speech spectrum is used for a high pass filter operation applied on the first spectrum, but the invention is not limited thereto. A center frequency of a time domain high pass filter that filters the first audio signal received by the microphone can be adjusted to the center frequency fc, and the time domain high pass filter filters out wind noise at low frequency from the first audio signal. Then, an FFT operation is applied on the filtered first audio signal to generate a fourth spectrum. The noise suppression device repeats processing of the fourth spectrum to enhance the human speech spectrum and suppress the noise spectrum according to the human speech spectrum and the noise spectrum, and a fifth spectrum is generated accordingly. In another embodiment, a new noise spectrum and a new human speech spectrum are generated according to the fourth spectrum, and the noise suppression device processes the fourth spectrum according to the new noise spectrum and the new human speech spectrum to enhance the human speech spectrum. In the end, an IFFT operation is applied to the fourth spectrum to generate a filtered audio signal.

Figure 3:
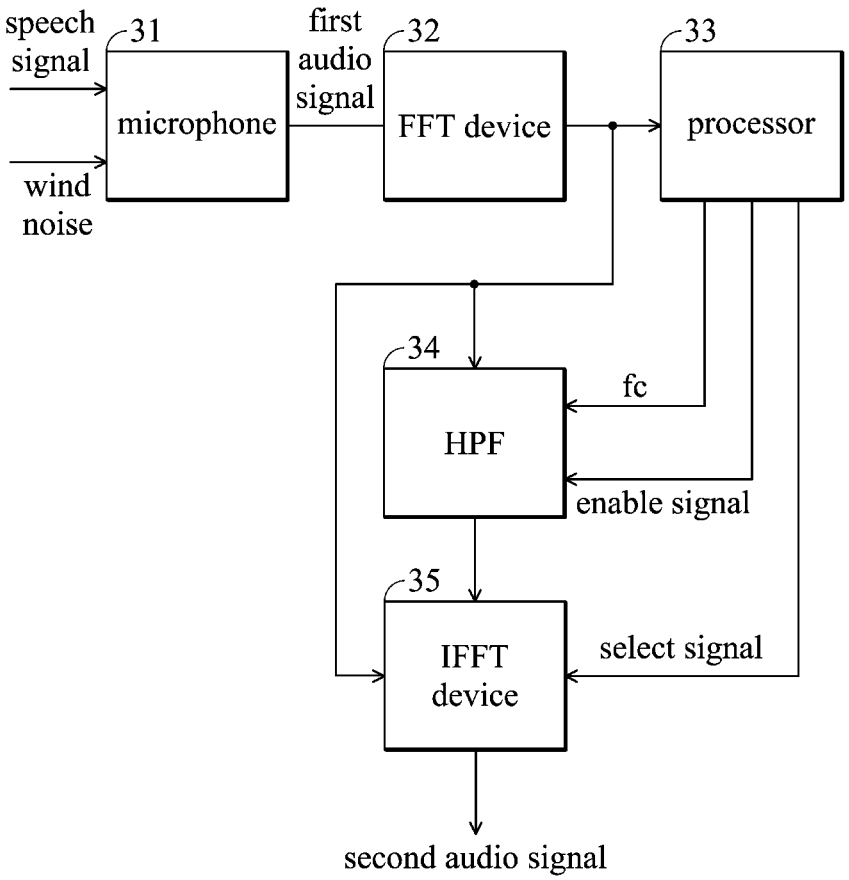
FIG. 3 is a schematic diagram of a portable device with a noise suppression function according to an embodiment of the invention.

FIG. 3 is a schematic diagram of a portable device with a noise suppression function according to an embodiment of the invention. The microphone 31 of the portable device receives a speech signal and wind noise to generate a first audio signal. In this embodiment, the microphone 31 may be made by a single microphone or a microphone array. The Fast Fourier Transform (FFT) device 32 applies an FFT operation to the first audio signal to generate a first spectrum and the first spectrum is transmitted to a processor 33, a high pass filter (HPF) 34 and an IFFT device 35. Generally speaking, the frequency of wind noise ranges from 0 to 100 Hz, and the frequency of human speech signals range from 300 Hz to 4K Hz. When the processor 33 receives the first spectrum, the processor 33 first acquires a noise spectrum corresponding to a first frequency range corresponding to the wind noise and determines whether the energy of the noise spectrum is larger than a predetermined value. If yes, the processor 33 transmits an enable signal to the HPF 34 to apply a high pass filter operation on the first spectrum. The processor 33 also transmits a select signal to the IFFT device 35 and the IFFT device 35 applies an inverse Fast Fourier Transform operation on the output of the HPF 34, not the first spectrum output by the FFT device 32. In other words, a multiplexer can be applied and coupled to the input of the IFFT device 35, and the multiplexer directs the output signal of HPF 34 or the first spectrum output by the FFT device 32 to the IFFT device 35 according to a select signal output by the processor 33.

If the energy of the noise spectrum is not larger than a predetermined value, the processor 33 does not transmit the enable signal to the HPF 34 and transmits the select signal to the IFFT device 35 and the IFFT device 35 applies an inverse Fast Fourier Transform operation on the first spectrum output by the FFT device 32. In another embodiment, if the energy of the noise spectrum is not larger than a predetermined value, and the processor 33 receives a control signal indicating that the user wants to apply a noise cancellation operation or noise suppress operation, the processor 33 transmits the enable signal to the HPF 34 to apply a high pass filter operation on the first spectrum. The processor 33 also transmits a select signal to the IFFT device 35 and the IFFT device 35 applies an inverse Fast Fourier Transform operation on the output of the HPF 34, not the first spectrum output by the FFT device 32. Thus, the processor 33 can pass or ignore the step of determining whether the energy of the noise spectrum is larger than a predetermined value.

After the processor 33 receives the first spectrum, the processor 33 first acquires a noise spectrum corresponding to a first frequency range and a human speech spectrum corresponding to a second frequency range. The processor 33 estimates a center frequency fc according to a first energy of the noise spectrum and a second energy of a human speech spectrum. When the center frequency of the HPF device 34 is adjusted to the center frequency fc, the HPF device 34 applies a high pass filter operation on the first spectrum to filter out the low frequency wind noise, and a second spectrum is then generated. The second spectrum is transmitted to the IFFT device 35 and the IFFT device 35 executes an IFFT operation to transform the second spectrum into a second audio signal. In this embodiment, the first frequency range ranges from 0 to 100 Hz, and the second frequency range ranges from 300 Hz to 4K Hz, but are not limited thereto.

The processor 33 can set different frequency ranges according to the type of noise and the processor 33 first determines the type of noise according to the first spectrum and then when the type of noise is determined, the processor 33 determines the center frequency of the HPF device 34 accordingly. In other words, the invention not only cancels or suppresses the wind noise, but also noise at any frequency range.

Figure 4:
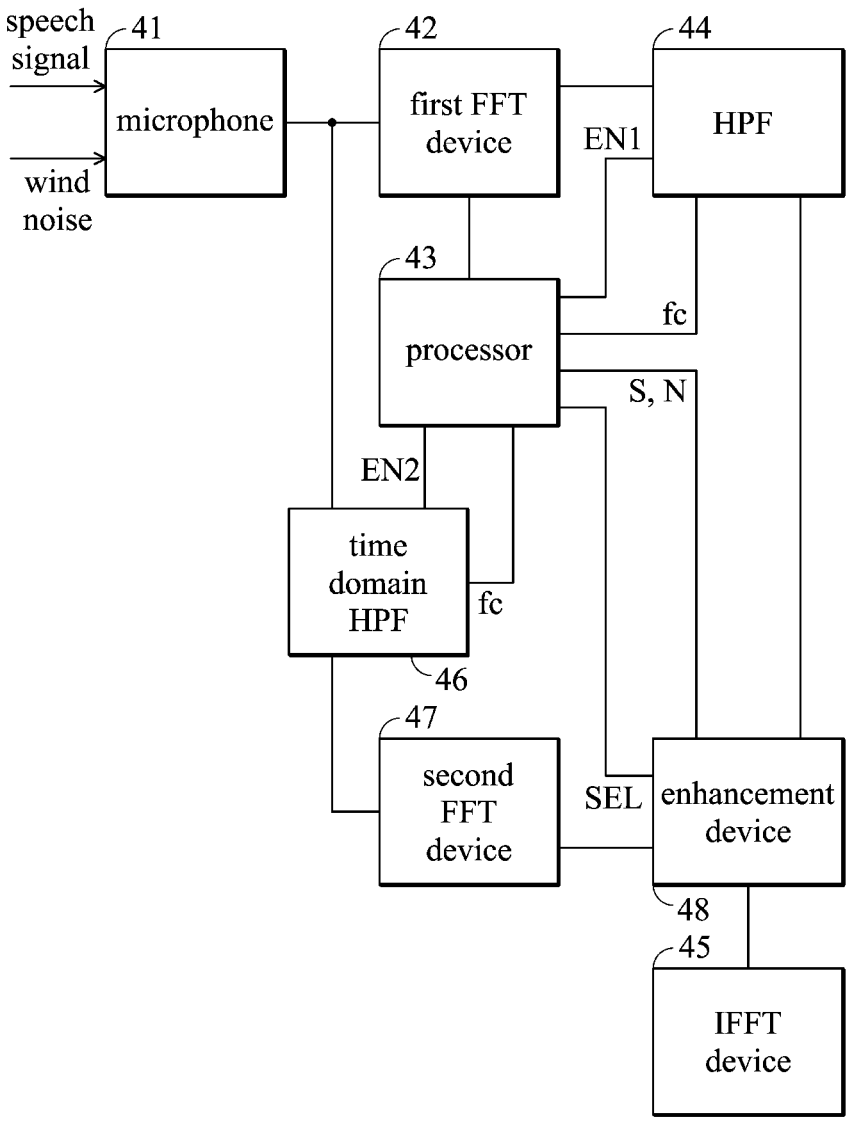
FIG. 4 is a schematic diagram of a portable device with a noise suppression function according to another embodiment of the invention.

FIG. 4 is a schematic diagram of a portable device with a noise suppression function according to another embodiment of the invention. The microphone 41 of the portable device receives a speech signal and wind noise to generate a first audio signal. In this embodiment, the microphone 41 may be made by a single microphone or a microphone array. The first Fast Fourier Transform (FFT) device 42 applies an FFT operation to the first audio signal to generate a first spectrum and the first spectrum is transmitted to a processor 43 and a high pass filter (HPF) 44. Generally speaking, the frequency of wind noise ranges from 0 to 100 Hz, and the frequency of human speech signals range from 300 Hz to 4K Hz. When the processor 43 receives the first spectrum, the processor 43 first acquires a noise spectrum N corresponding to a first frequency range corresponding to the wind noise and determines whether the energy of the noise spectrum PN is larger than a predetermined value PTH. If yes, the processor 43 transmits an enable signal EN1 to the HPF 44 to apply a high pass filter operation on the first spectrum. The processor 43 also transmits a first enable signal EN1 to the HPF 45 to execute an HPF operation. In the embodiment, the processor 43 can also transmit a second enable signal (EN2) to the HPF device 46 and the HPF 46 executes an HPF operation on the first audio signal to generate a first filtered audio signal.

In this embodiment, the processor 43 can select only one of the frequency domain HPF 44 and time domain HPF 46 to execute the filter operation, or both the frequency domain HPF 44 and time domain HPF 46 execute the filter operation. If both the frequency domain HPF 44 and time domain HPF 46 work simultaneously, the processor 43 transmits a select signal SEL to the enhancement device 48 and the enhancement device 48 processes the output signal from the frequency domain HPF 44 or a second FFT device 47 according to the select signal SEL. In other words, a multiplexer can be applied for directing the output signal from the frequency domain HPF 44 or the output signal from the second FFT device 47 to the enhancement device 48 according to the select signal SEL. The enhancement device 48 can be implemented by hardware or software to enhance the human voice signal of the received signal and suppress the wind noise of the received signal.

When the processor 43 receives the first spectrum, the processor 43 acquires a noise spectrum N corresponding to a first frequency range corresponding to the noise and a human speech spectrum corresponding to the second frequency range corresponding to the human speech signal. The processor 43 calculates a ratio (PN/PS) according to a first energy of the noise spectrum and the second energy of the human speech spectrum to estimate a center frequency fc. The controlled 43 then adjusts the center frequency of both the frequency domain HPF 44 and time domain HPF 46 to be fc. When the center frequency of frequency domain HPF 44 is set, the first spectrum is filtered by the frequency domain HPF 44, the wind noise at low frequency is filtered out from the first spectrum, and a second spectrum is generated accordingly. When the center frequency of time domain HPF 46 is set, the first audio signal is filtered by the time domain HPF 46 the wind noise at low frequency is filtered out from the first spectrum, and a second audio signal is generated accordingly. The second audio signal is transmitted to the second FFT device 47 to generate a third spectrum.

The processor 43 transmits the noise spectrum N and the human speech spectrum S to the enhancement device 48. The enhancement device 48 receives the second spectrum or the third spectrum according to a select signal SEL, and enhances the human speech of the received spectrum and suppresses the noise of the received spectrum. For example, the second spectrum can be represented as (S2+N2). The enhancement device 48 calculates an average spectrum of the second spectrum and the human speech spectrum, wherein the average spectrum can be represented as ((S+S2)/2+N2/2). Then the enhancement device 48 subtracts the noise spectrum N from the average spectrum to generate the result: ((S+S2)/2+(N2=N)/2). According to this way, a signal to noise ratio between the human speech spectrum (S+S2)/2 and the noise spectrum (N2−N)/2) becomes larger and the quality of the output audio signal becomes better accordingly. The enhancement device 48 outputs a fourth spectrum to the IFFT device 45 and an IFFT operation is applied to the fourth spectrum to generate a third audio signal. The processor 43 can set different frequency ranges according to the type of noise and the processor 43 first determines the type of noise according to the first spectrum and then when the type of noise is determined, the processor 43 determines the center frequency of the frequency domain HPF 44 and the time domain HPF 46 accordingly. In other words, the invention not only cancels or suppresses the wind noise, but also the noise at any frequency range.

Although the description of the embodiment in FIG. 3 does not mention the enhancement device 48, the enhancement device 48 can also be applied to the embodiment in FIG. 3 for better signal quality.

The generation of the center frequency and how the processor 43 detects noises are explained in the following. The signal received by the microphone 41 is first sampled by an analog to digital converter with 48K Hz sampling rate to generate a digital signal. The digital signal is transmitted to a 256 points Fast Fourier Transform device to generate a corresponding spectrum. Energy of a first band of the spectrum and energy of a second band of the spectrum are used to determine whether the noise exists. The frequency of wind noise can be acquired by the following equation:

$$2/256*48K\ Hz=375\ Hz$$

The processor 43 determines the center frequency fc according to a signal to noise (SNR) ratio of the noise and the human speech signal. The SNR ratio is determined by the following equation:

$$SNR=\text{the energy from band 3 to band 24/the energy from band 1 to band 2}$$

=the energy from 375 Hz to 4K Hz/the energy from 0 to 375 Hz

In the present application, the frequency of the center frequency fc estimated by the SNR ranges from 100 Hz to 1000 Hz.

Figure 5:
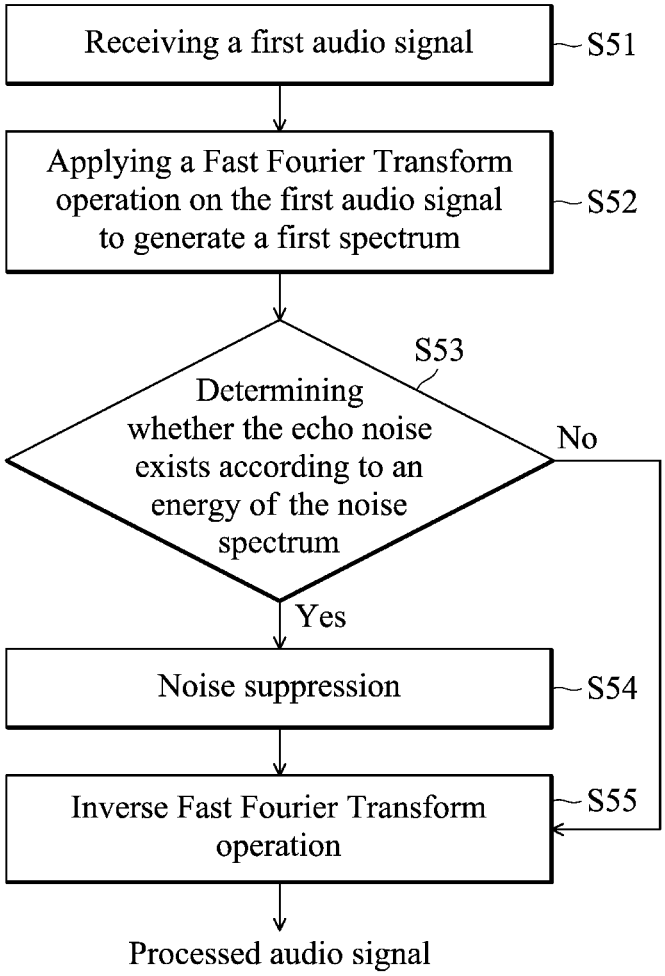
FIG. 5 is a flowchart of another embodiment of a noise cancellation method for a microphone according to the invention.

FIG. 5 is a flowchart of another embodiment of a noise cancellation method for a microphone according to the invention. The embodiment in FIG. 5 is illustrated with an indoor situation. The noise indoors is usually generated by the echo signal. Thus, an audio signal received at a previous time point is applied to suppress the noise of an audio signal received at a next time point. In the step S51, a microphone receives a first audio signal containing a speech signal of a user and an echo. In step S52, a Fast Fourier Transform device applies a Fast Fourier Transform (FFT) operation on the first audio signal to generate a first spectrum. In step S53, a processor or a controller determines whether the echo noise exists according to the energy of the first spectrum. If the echo noise does not exist, the step S55 is executed. If the echo noise exists, the step S54 is executed. In the step S54, an echo spectrum is estimated according to the spectrum generated according to a previous audio signal. Then, a noise suppression operation is applied to the first spectrum according to the echo noise spectrum to generate a second spectrum. The second spectrum is transformed into a third audio signal by an Inverse Fast Fourier Transform operation in step S55.

Figure 6:
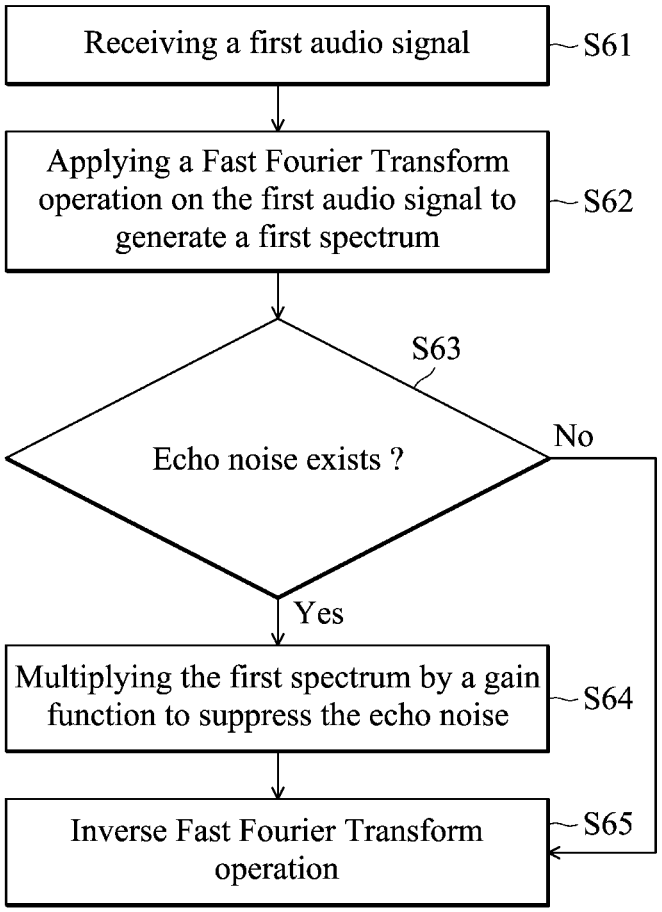
FIG. 6 is a flowchart of another embodiment of a noise cancellation method for a microphone according to the invention.

FIG. 6 is a flowchart of another embodiment of a noise cancellation method for a microphone according to the invention. The embodiment in FIG. 6 is illustrated with an indoor situation. In the step S61, a microphone receives a first audio signal x(t) containing a speech signal of a user and an echo. In step S62, a Fast Fourier Transform device applies a Fast Fourier Transform (FFT) operation on the first audio signal x(t) to generate a first spectrum x(k). In step S63, a processor or a controller determines whether the echo noise exists according to the energy of the first spectrum. If the echo noise does not exist, the step S65 is executed. If the echo noise exists, the step S64 is executed. In the step S64, the first spectrum x(k) is multiplied by a gain function to suppress the echo noise. The gain function g(k) can be generated or set by a user or a processor of a portable device. The spectrum Y(k) generated in step S64 is shown as following:

$$Y(k)=g(k)*x(k)$$

The gain value of the gain function g(k) ranges from 0.1 to 1. For example, if the Fast Fourier Transform executed in step S62 is a 256 points Fast Fourier Transform, the gain function g(k) comprises 256 gain values to adjust the energy of each point of the first spectrum. Furthermore, in step S64, an echo spectrum n(k) is also estimated according to the first audio signal or the first spectrum. The echo noise spectrum n(k) is represented by the equation:

$$n(k)=(1-g(k))*u(k)$$

, wherein u(k) is the original estimated noise.

Then, a second spectrum is generated by subtracting n(k) from Y(k). In the step S65, the second spectrum is transformed into a third audio signal x"(t) by an Inverse Fast Fourier Transform operation.

Figure 7:
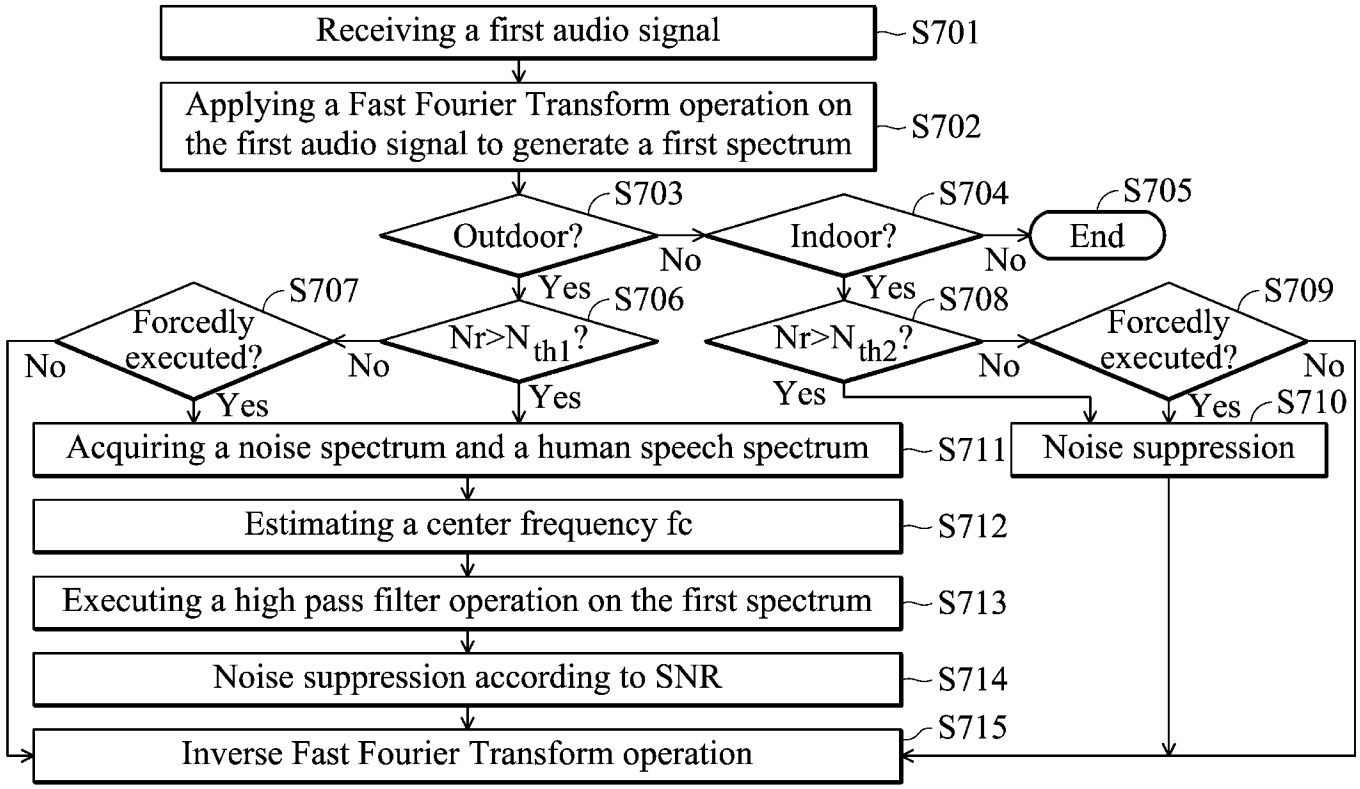
FIG. 7 is a flowchart of another embodiment of a noise cancellation method for a microphone according to the invention.

FIG. 7 is a flowchart of another embodiment of a noise cancellation method for a microphone according to the invention. In step S701, a first audio signal containing a speech signal of a user and a noise is received by a microphone. In step S702, an FFT device applies an FFT operation to the first audio signal to generate a first spectrum. In step S703, a processor or a controller determines whether a user is outdoors.

Generally speaking, the frequency of wind noise ranges from 0 to 100 Hz, and the frequency of human speech signals range from 300 Hz to 4K Hz. In this embodiment, the user or designer sets a first frequency range corresponding to the wind noise and a second frequency range corresponding to the speech signal and acquires a noise spectrum corresponding to the first frequency range and a human speech spectrum corresponding to the second frequency range by an application program. Then, a first determination device may determine whether a user is outdoors according to the energy of the noise spectrum. If the user is determined not to be outdoors, the step S704 is executed. If the user is determined to be outdoors, the step S706 is executed In the step S706, the energy of the noise spectrum Nr is compared with a first predetermined value Nth1. If the energy of the noise spectrum Nr is larger than the first predetermined value Nth1, the step S711 is executed to cancel the noise. If the energy of the noise spectrum Nr is smaller than the first predetermined value Nth1, the step 707 is executed. In the step S707, the noise suppression function is determined to be forcedly executed or not according to user settings. For example, when the user uses a portable device to execute a video recording program or a voice recording program, an operational menu is jumped and shown on the display of the portable device for the user to determine whether the noise cancellation or suppression operation should be executed. If the answer of step S707 is yes, wherein the noise cancellation operation or suppression operation has to be executed, step S711 is then executed. If the answer of step S707 is no, wherein the noise cancellation operation or suppression operation does not have be executed, step S715 is then executed. In step S715, an IFFT operation is applied to the first spectrum to generate a second audio signal.

In step S711, a signal to noise (SNR) ratio is estimated according to the energy of the noise spectrum and the energy of the human speech spectrum. In the step S712, a center frequency fc is estimated according to the SNR ratio. A center frequency of a frequency domain high pass filter is adjusted according to the center frequency fc, the first spectrum is filtered by the frequency domain high pass filter to filter out the wind noise at low frequency in step S713, and a second spectrum is therefore generated. In step S714, a noise suppression operation is applied to the second spectrum again according to the noise spectrum and the human speech spectrum to enhance the human speech of the second spectrum and suppress the wind noise of the second spectrum. A third spectrum is generated accordingly. In step S714, the third spectrum is processed by the IFFT operation to generate a filtered audio signal.

In step S704, a second determination device may determine whether the user is indoors according to the first spectrum. In one embodiment, the second determination device may determine whether the echo noise exists according to two successive spectrums. If the result of step S704 is no, step S705 is executed. If the result of step S704 is yes, step S708 is executed. In step S708, an indoor noise, such as an echo, is estimated according to the first spectrum, and the energy of the indoor noise Nr is compared with a second predetermined value Nth2. If the energy of the indoor noise Nr is larger than the second predetermined value Nth2, the step S716 is executed to suppress the noise. For the operation of the step S716, reference can be made to the description of FIG. 6. If the energy of the indoor noise Nr is smaller than the second predetermined value Nth2, the step S09 is executed. In the step S709, the noise suppression function is determined to be forcedly executed or not according to user settings. For example, when the user uses a portable device to execute a video recording program or a voice recording program, an operational menu is jumped and shown on the display of the portable device for the user to determine whether the noise cancellation or suppression operation should be executed. If the answer of step S709 is yes, step S716 is then executed. If the answer of step S709 is no, step S715 is then executed. In step S715, the first spectrum is processed by the IFFT operation to generate a second audio signal.

Figure 8:
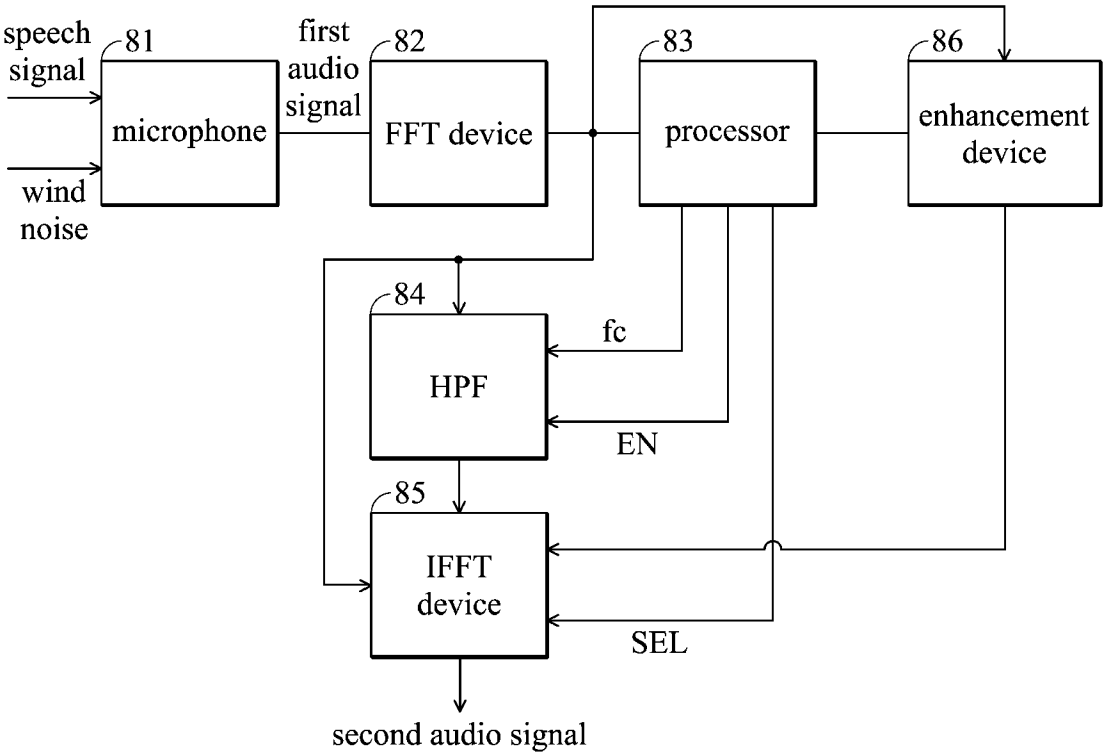
FIG. 8 is a schematic diagram of another embodiment of a portable device with a noise suppression function according to the invention.

FIG. 8 is a schematic diagram of another embodiment of a portable device with a noise suppression function according to the invention. The microphone 81 of the portable device receives a speech signal and wind noise to generate a first audio signal. In this embodiment, the microphone 81 may be made by a single microphone or a microphone array. The Fast Fourier Transform (FFT) device 82 applies an FFT operation to the first audio signal to generate a first spectrum and the first spectrum is transmitted to a processor 83, a high pass filter (HPF) 84 and an Inverse Fast Fourier Transform (IFFT) device 85. Generally speaking, the frequency of wind noise ranges from 0 to 100 Hz, and the frequency of human speech signals range from 300 Hz to 4K Hz. When the processor 83 receives the first spectrum, the processor 83 first acquires a noise spectrum corresponding to a first frequency range corresponding to the wind noise and determines whether the energy of the noise spectrum is larger than a predetermined value. If yes, the processor 83 transmits an enable signal to the HPF 84 to apply a high pass filter operation on the first spectrum. The processor 83 also transmits a select signal to the IFFT device 85 and the IFFT device 85 applies an inverse Fast Fourier Transform operation on the output signal of the HPF 84, not the first spectrum output by the FFT device 82 or a third spectrum output by the enhancement device 86. In other words, a multiplexer can be applied and coupled to the input of the IFFT device 85. The multiplexer directs the output signal of HPF 84, the first spectrum output by the FFT device 82 or the third spectrum output by the enhancement device 86 to the IFFT device 85 for further processing according to a select signal output by the processor 83.

If the energy of the noise spectrum is not larger than a predetermined value, the processor 83 does not transmit the enable signal to the HPF 84 and transmits the select signal to the IFFT device 85. The IFFT device 85 applies an inverse Fast Fourier Transform operation on the first spectrum output by the FFT device 82 according to the select signal. In other embodiment, if the energy of the noise spectrum is not larger than a predetermined value, and the processor 83 receives a control signal indicating that the user wants to apply a noise cancellation operation or noise suppress operation on the audio signal received by the microphone 81, the processor 83 directly transmits the enable signal to the HPF 84 to apply a high pass filter operation on the first spectrum. The processor 83 also transmits a select signal to the IFFT device 85 and the IFFT device 85 applies an inverse Fast Fourier Transform operation on the output signal of the HPF 84, not the first spectrum output by the FFT device 82. Thus, the processor 83 can pass or ignore the step of determining whether the energy of the noise spectrum is larger than a predetermined value.

After the processor 83 receives the first spectrum, the processor 83 first acquires a noise spectrum corresponding to a first frequency range and a human speech spectrum corresponding to a second frequency range. The processor 83 estimates a center frequency fc according to a first energy of the noise spectrum and a second energy of a human speech spectrum. After the center frequency of the HPF device 84 is adjusted to the center frequency fc, the HPF device 84 applies a high pass filter operation on the first spectrum to filter out the low frequency wind noise, and a second spectrum is then generated. The second spectrum is transmitted to the IFFT device 85 and the IFFT device 85 executes an IFFT operation to transform the second spectrum into a second audio signal. In this embodiment, the first frequency range ranges from 0 to 100 Hz, and the second frequency range ranges from 300 Hz to 4K Hz, but are not limited thereto. The processor 83 can set different frequency ranges according to the type of noise and the processor 83 first determines the type of noise according to the first spectrum and then when the type of noise is determined, the processor 83 determines the center frequency of the HPF device 84 accordingly. In other words, the invention not only cancels or suppresses the wind noise, but also the noise at any frequency range.

When the processor 83 receives the first spectrum and determines that the portable device is indoors, the first spectrum is transmitted to the enhancement device 86. At the same time, the processor 83 transmits the select signal SEL to the IFFT device 85 to process the output signal of the enhancement device 86. The enhancement 86 estimates a noise spectrum according to a previous received audio signal, and executes a noise suppression operation on the first spectrum according to the noise spectrum to generate a third spectrum. The third spectrum is then transmitted to the IFFT device 85 to generate a third audio signal by applying an IFFT operation on the third spectrum.

Figure 9:
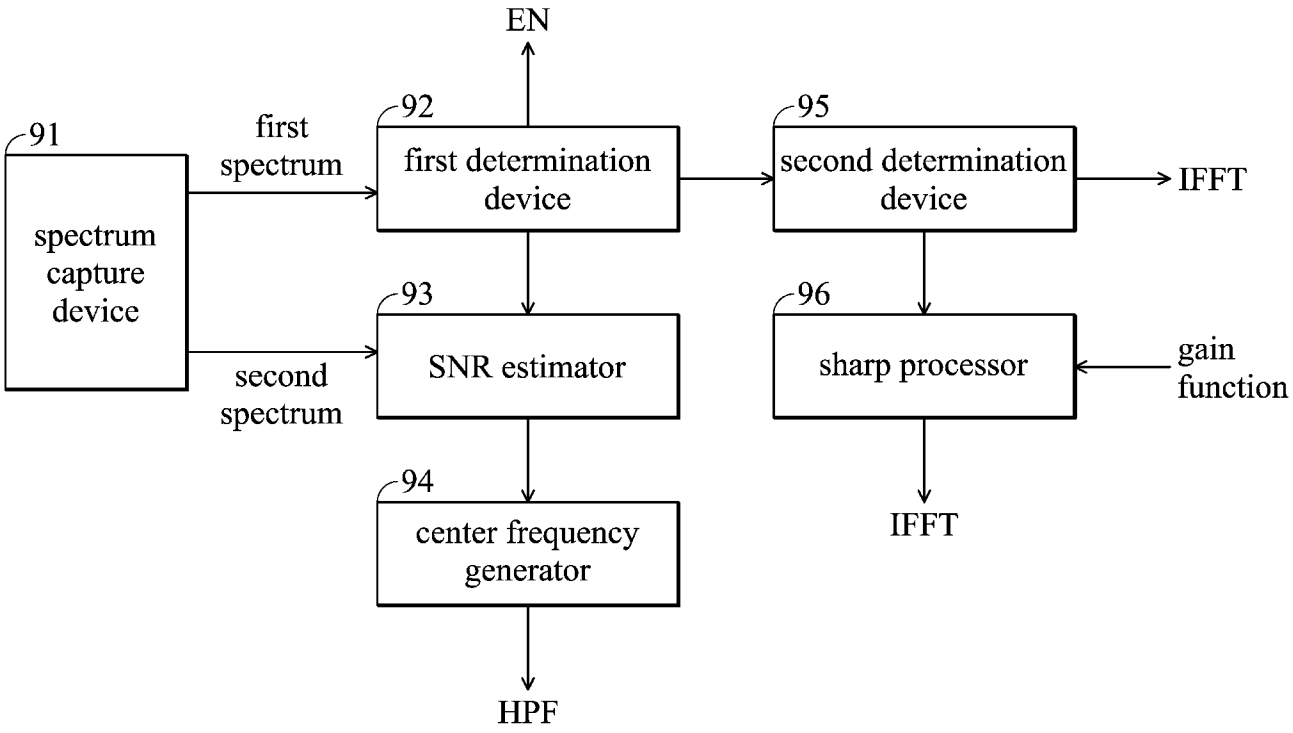
FIG. 9 is a schematic diagram of an embodiment of a noise cancellation device according to the invention.

FIG. 9 is a schematic diagram of an embodiment of a noise cancellation device according to the invention. The noise cancellation device is embedded in an electronic device having a voice receiving mean. The noise cancellation device comprises a spectrum capture device 91, a first determination device 92, a second determination device 95, an SNR estimator 93, a center frequency generator 94 and a sharp processor 96. The spectrum capture device 91 receives an audio spectrum transformed by an audio signal and acquires a noise spectrum corresponding to a first frequency range corresponding to a noise and a human speech spectrum corresponding to the second frequency range corresponding to a human speech signal. The first determination device 92 receives the first spectrum and determines whether the electronic device is outdoors. If the electronic device is determined to be outdoors, an enable signal EN is transmitted to the high pass filter. If the electronic device is not determined to be outdoors, the first spectrum is transmitted to a second determination device 95 to determine whether the first spectrum needs to be processed by a voice sharp process. If the second determination device 95 determines that the first spectrum does not need to be processed by a voice sharp process, the first spectrum is transmitted to an inverse Fast Fourier Transform device to output a first audio signal. If the second determination device 95 determines that the first spectrum does need to be processed by a voice sharp process, the first spectrum is transmitted to the sharp processor 96 for further processing. For the operation method and detailed operation of the sharp processor, reference can be made to the description of FIG. 6.

The SNR estimator 93 estimates an SNR ratio according to the energy of the first spectrum and the energy of the second spectrum. The SNR ration is transmitted to a center frequency generator 94 to estimate a center frequency fc. The high pass filter adjusts its center frequency according to the center frequency fc and applies a high pass filter operation to the audio spectrum. Then, the output of the high pass filter is transmitted to an IFFT device to output a second audio signal.

Figure 10:
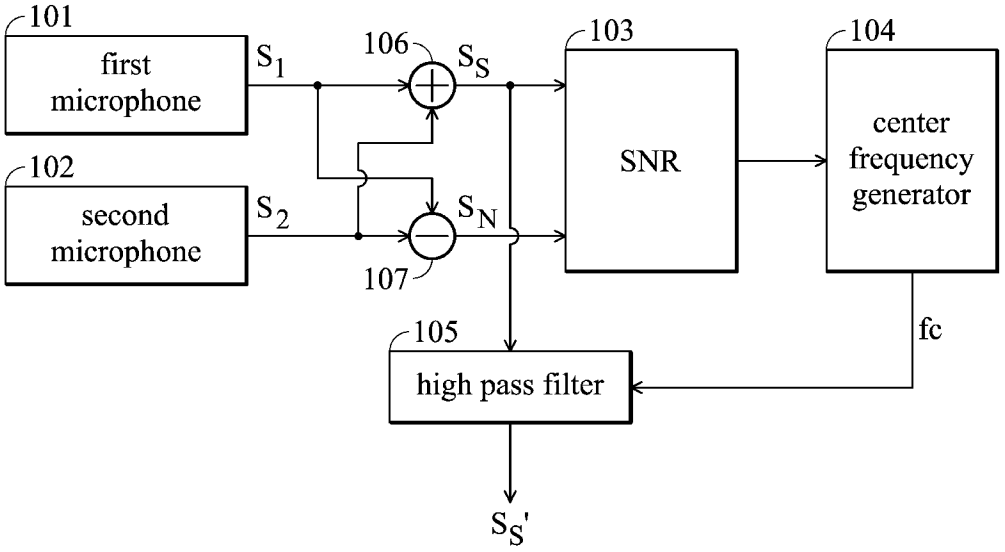
FIG. 10 is a schematic diagram of another embodiment of a noise cancellation device according to the invention.
Figure 11:
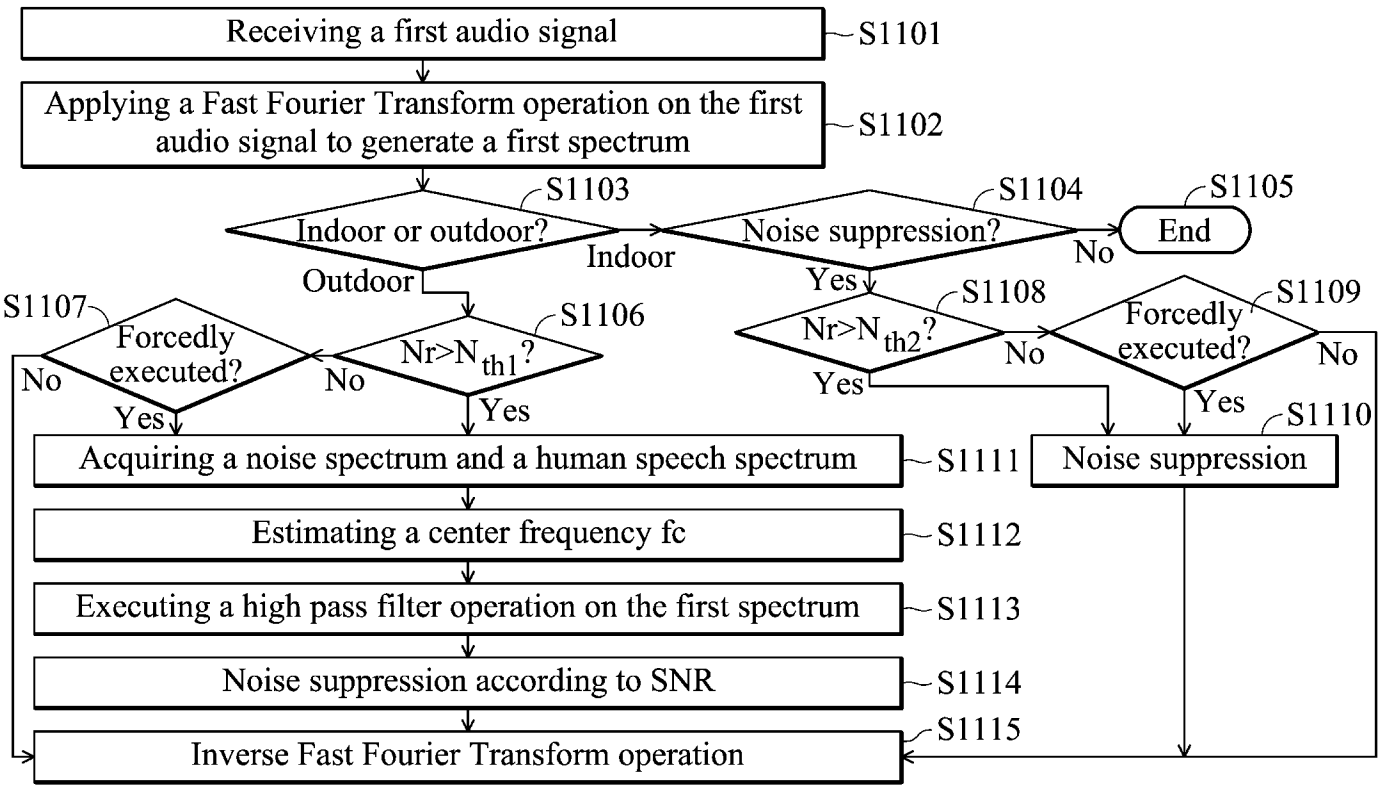
FIG. 11 is a flowchart of a noise cancellation method according to another embodiment of the invention.

FIG. 10 is a schematic diagram of another embodiment of a noise cancellation device according to the invention. The first microphone 101 receives a first audio signal S1 and the second microphone 102 receives a second audio signal S2. The adder 106 adds the first audio signal S1 to the second audio signal S2 to generate a human speech signal $S_S$. The subtractor 107 substrates the first audio signal S1 from the second audio signal S2 to generate a noise signal $S_N$. The SNR estimator 103 estimates an SNR ratio according to the energy of the human speech signal $S_S$ and the energy of the noise signal $S_N$. The SNR ration is transmitted to a center frequency generator 104 to estimate a center frequency fc. The high pass filter 105 adjusts its center frequency according to the center frequency fc and executes a high pass filter operation to the human speech signal $S_S$ to generate a filtered human speech signal $S_S'$ FIG. 11 is a flowchart of a noise cancellation method according to another embodiment of the invention. In step S1101, a first audio signal containing a speech signal of a user and a noise is received by a microphone. In step S1102, an FFT device applies an FFT operation to the first audio signal to generate a first spectrum. In step S1103, a processor or a controller determines whether a user is outdoors or indoors.

Generally speaking, the frequency of wind noise ranges from 0 to 100 Hz, and the frequency of human speech signals range from 300 Hz to 4K Hz. In this embodiment, the user or designer sets a first frequency range corresponding to the wind noise and a second frequency range corresponding to the speech signal and acquires a noise spectrum corresponding to the first frequency range and a human speech spectrum corresponding to the second frequency range by an application program. Then, a first determination device may determine whether a user is outdoors according to the energy of the noise spectrum.

In this embodiment, a second determination device may determine whether the user is indoors according to the first spectrum. In one embodiment, the second determination device may determine whether the echo noise is generated according to two successive spectrums. If the user is determined to be indoors, the step S1104 is executed. If the user is determined to be outdoors, the step S1106 is executed In the step S1106, the energy of the noise spectrum Nr is compared with a first predetermined value Nth1. If the energy of the noise spectrum Nr is larger than the first predetermined value Nth1, the step S1111 is executed to cancel the noise. If the energy of the noise spectrum Nr is smaller than the first predetermined value Nth1, the step 1107 is executed. In the step S1107, the noise suppression function is determined to be forcedly executed or not according to user settings. For example, when the user uses a portable device to execute a video recording program or a voice recording program, an operational menu is jumped and shown on the display of the portable device for the user to determine whether the noise cancellation or suppression operation should be executed. If the answer of step S1107 is to execute the noise cancellation or suppression operation, step S111 is then executed. If the answer of step S1107 is not to execute the noise cancellation or suppression operation, step S1115 is then executed. In step S1115, an IFFT operation is applied to the first spectrum to generate a second audio signal.

In step S1111, a signal to noise (SNR) ratio is determined according to the energy of the noise spectrum and the energy of the human speech spectrum. In the step S1112, a center frequency fc is estimated according to the SNR ratio. A center frequency of a frequency domain high pass filter is adjusted according to the center frequency fc, and the first spectrum is filtered by the frequency domain high pass filter to filter out the wind noise at low frequency, and a second spectrum is therefore generated. In step S1114, noise suppression is applied to the second spectrum according to the noise spectrum and the human speech spectrum to enhance the human speech and suppress the wind noise. A third spectrum is generated accordingly. In step S1114, the third spectrum is processed by the IFFT operation to generate a filtered audio signal.

In step S1104, a second determination device may determine whether the user is indoors according to the first spectrum. In one embodiment, the second determination device may determine whether the echo noise exists according to two successive spectrums If the result of step S1104 is no, step S1105 is executed. If the result of step S1104 is yes, step S1108 is executed. In step S1108, indoor noise, such as an echo, is estimated according to the first spectrum, and the energy of the indoor noise Nr is compared with a second predetermined value Nth2. If the energy of the indoor noise Nr is larger than the second predetermined value Nth2, the step S1116 is executed to suppress the noise. For the operation of the step S1116, reference can be made to the description of FIG. 6. If the energy of the indoor noise Nr is smaller than the second predetermined value Nth2, the step S1109 is executed.

In the step S1109, the noise suppression function is determined to be forcedly executed or not according to user settings. For example, when the user uses a portable device to execute a video recording program or a voice recording program, an operational menu is jumped and shown on the display of the portable device for the user to determine whether the noise cancellation or suppression operation should be executed. If the answer of step S1109 is yes, step S1116 is then executed. If the answer of step S1109 is no, step S1115 is then executed. In step S1115, the first spectrum is processed by the IFFT operation to generate a second audio signal.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A noise cancellation method for an electronic device, comprising:

receiving a first audio signal containing a speech signal of a user and a noise signal received by a microphone;

applying a Fast Fourier Transform operation on the first audio signal to generate a first spectrum, wherein the first spectrum contains a noise spectrum corresponding to a predetermined frequency range for a noise signal, and a voice spectrum corresponding to a predetermined frequency range for a speech signal;

determining whether the user is outdoors or indoors according to an energy of the noise spectrum;

comparing the energy of noise spectrum with a first predetermined value, when the user is determined to be outdoors;

applying a first noise suppression to the first spectrum to remove outdoor noise when the energy of noise spectrum is larger than the first predetermined value;

providing the user with an interface for the user to determine whether to forcedly apply the first noise suppression when the energy of noise spectrum is smaller than the first predetermined value;

comparing the energy of noise spectrum with a second predetermined value, when the user is determined to be indoors;

applying a second noise suppression to the first spectrum to remove indoor noise when the energy of noise spectrum is larger than the second predetermined value;

providing the user with an interface for the user to determine whether to forcedly apply the second noise suppression when the energy of noise spectrum is smaller than the second predetermined value; and applying an Inverse Fast Fourier Transform operation on the first spectrum to generate a second audio signal.

2. The method as claimed in claim 1, wherein the step of applying the first or second noise suppression to the first spectrum comprises the steps of:

acquiring the noise spectrum and the voice spectrum;

estimating a center frequency according to the noise spectrum and the voice spectrum; and applying a high pass filtering operation to the first spectrum according to the center frequency.

3. The method as claimed in claim 2, wherein the step of estimating a center frequency further comprises:

estimating a signal-to-noise ratio according to the energy of the noise spectrum and an energy of the voice spectrum; and adjusting a gain value of the noise spectrum according to the signal-to-noise ratio.

4. The method as claimed in claim 1, wherein the first or second noise suppression is operated by a high pass filter for filtering out the first spectrum lower than a center frequency ranges of 100 Hz to 1000 Hz.

5. The method as claimed in claim 1, wherein the noise spectrum has a frequency which ranges from 0 to 300 Hz, and the voice spectrum has a frequency which ranges from 300 Hz to 4000 Hz.

* * * * *